US009048054B2

(12) United States Patent
Potratz

(10) Patent No.: US 9,048,054 B2
(45) Date of Patent: Jun. 2, 2015

(54) CIRCUIT BREAKER WITH PLUG ON NEUTRAL CONNECTION LOCK-OUT MECHANISM

(75) Inventor: Jason Potratz, North Liberty, IA (US)

(73) Assignee: SCHNEIDER ELECTRIC USA, INC., Palatine, IL (US)

( * ) Notice: Subject to any disclaimer, the term of this patent is extended or adjusted under 35 U.S.C. 154(b) by 1220 days.

(21) Appl. No.: 12/956,736

(22) Filed: Nov. 30, 2010

(65) Prior Publication Data

US 2012/0132506 A1 May 31, 2012

(51) Int. Cl.

| | |
|---|---|
| ***H01H 9/28*** | (2006.01) |
| ***H01H 83/02*** | (2006.01) |
| ***H01H 9/20*** | (2006.01) |
| ***H01H 83/22*** | (2006.01) |
| *H01H 83/20* | (2006.01) |

(52) U.S. Cl.

CPC ..... *H01H 83/02* (2013.01); *H01H 9/20* (2013.01); *H01H 83/223* (2013.01); *H01H 2083/201* (2013.01); *H01H 2083/203* (2013.01)

(58) Field of Classification Search

CPC ..... H01H 9/20; H01H 71/62; H01H 71/505; H01H 77/06; H01H 71/125; G01R 31/025; H02H 1/0015

USPC ..... 200/43.11

See application file for complete search history.

(56) References Cited

U.S. PATENT DOCUMENTS 5,847,913 A * 12/1998 Turner et al. ..... 361/93.1
6,040,967 A 3/2000 DiSalvo
6,242,993 B1 * 6/2001 Fleege et al. ..... 335/18
6,288,882 B1 9/2001 DiSalvo
6,313,641 B1 11/2001 Brooks (Continued)

OTHER PUBLICATIONS

International Search Report corresponding to co-pending International Patent Application Serial No. PCT/US2011/057458, European Patent Office, dated Jan. 24, 2012, 4 pages.

(Continued)

*Primary Examiner* — Renee Luebke
*Assistant Examiner* — Lheiren Mae A Caroc
(74) *Attorney, Agent, or Firm* — Locke Lord LLP

(57) ABSTRACT

A circuit breaker is disclosed that has a neutral lock-out mechanism that prevents electrical connection between a power source and a load when a neutral rail is disconnected from the circuit breaker. The circuit breaker has a line connector, a load connector and a plug-on neutral line connector. A trip mechanism has an on position allowing electrical connection between the line connector and the load connector. The trip mechanism has a tripped position interrupting electrical connection between the line connector and the load connector in response to detection of a fault condition such as a short circuit. The trip mechanism also has an off position which is required before resetting the trip mechanism to the on position. A trip link is coupled to the trip mechanism. The trip link has a first position that prevents the trip mechanism from being reset to the on position. The trip link has a second position allowing the trip mechanism to be reset to the on position. A neutral lock mechanism is coupled to the plug-on neutral line connector. The neutral lock mechanism has a tension spring that retains the trip link in the first position when the neutral rail is disconnected from the neutral line connector. When the neutral rail is inserted into the neutral line connector, the tension spring is compressed and the trip link may move to the second position allowing the circuit breaker to be reset.

16 Claims, 9 Drawing Sheets

(56) References Cited

U.S. PATENT DOCUMENTS

| | | | | |
|---|---|---|---|---|
| 6,477,022 | B1 | 11/2002 | Ennis et al. | |
| 6,482,048 | B1 | 11/2002 | Fleege et al. | |
| 6,717,782 | B2 * | 4/2004 | DiSalvo et al. | 361/42 |
| 7,545,244 | B2 * | 6/2009 | DiSalvo et al. | 335/18 |

OTHER PUBLICATIONS

International Written Opinion corresponding to co-pending International Patent Application Serial No. PCT/US2011/057458, European Patent Office, dated Jan. 24, 2012, 5 pages.

* cited by examiner

CIRCUIT BREAKER WITH PLUG ON NEUTRAL CONNECTION LOCK-OUT MECHANISM

FIELD OF THE INVENTION

Aspects disclosed herein relate generally to circuit breakers, and, more particularly, to a circuit breaker having a lock-out mechanism to resetting the circuit breaker if an open neutral condition exists.

BACKGROUND

As is well-known, circuit breakers provide automatic power interruption to a monitored load when undesired fault conditions, such as an overload of current or a short circuit, occur. A circuit breaker is typically wired between a load and a power source on a line conductor. The load receives power from the line conductor from the circuit breaker and is directly connected to a ground conductor. A neutral rail or conductor is also connected to the power source through the circuit breaker to provide a return for the current back to the power source. A circuit breaker is an automatically operated electro-mechanical device designed to protect the load from damage when a fault occurs by breaking the connection on the line conductor to the load. A typical circuit breaker has a load connector and a line connector with a break mechanism interposed between the load connector (connected to the power input of a load device) and the line connector (connected to the power lead of a power source such as a panel board). Various fault conditions trip the circuit breaker thereby interrupting power flow between the load and the power source. A circuit breaker can be reset (either manually or automatically) to resume current flow to the load.

Circuit breakers have mechanical mechanisms that are tripped by overcurrents to interrupt power to a load. An overcurrent may be detected when the fault current generates sufficient heat in a bimetal strip causing the strip to bend. The mechanical deflection triggers a trip mechanism that includes a spring-biased trip lever to force a moveable contact attached to a moveable conductive blade away from a stationary contact, thereby breaking the circuit.

Other fault conditions may also include, for example, arc faults and ground faults which also require the interruption of the connection between the load and the power source. Such conditions require sensing electrical signals on the connection rather than a mechanical trigger. In order to provide protection against such faults, a circuit breaker may therefore also include electronic components that detect such fault conditions and cause the circuit breaker to electronically trip. The electronic components may be provided in addition to the thermal-magnetic tripping components. The electronic components process a signal output of a sensor that monitors current flowing in the circuit breaker to determine whether one of the fault conditions is present and to generate a fault signal and/or a trip signal. In response to the generation of a fault signal, a plunger is electrically activated trigger the trip mechanism and thereby interrupt power to the load.

The above mechanisms provide protection against fault conditions which occur from the line and neutral conductors that carry the power to the load. However, the neutral conductor also requires protection against accidental disconnection (open-neutral conditions) that will create a dangerous ungrounded open circuit for the load. For example, a potentially dangerous situation results from an open-neutral condition due to the panel board neutral connection of an electronic circuit breaker becoming unplugged while the line side connection between the circuit breaker and load remain connected. The situation is dangerous because in electronic circuit breakers, the electronics of the circuit breaker are sometimes powered between the line and neutral conductors (line-to-neutral powered) and will not function if the neutral connection between the circuit breaker and the panel in which the breaker is installed is lost. If the electronics of the circuit breaker are not powered, the circuit breaker will lose its advanced protection functions such as detection of ground faults or arc faults. Also, voltage may be supplied to loads which appear to be off and do not run because no current can flow, and because the neutral side of the circuit, which is normally near ground potential, is now near the potential level of the line power supply. In certain situations, there may be increased risk of losing this connection with a plug-on panel neutral connection which could be inadvertently disconnected if the circuit breaker is inadvertently bumped during service of an adjacent circuit breaker causing the panel board neutral connection to become unplugged.

Therefore there is a need for a circuit breaker that will be tripped when the neutral connection becomes unplugged. There is also a need for a mechanism that prevents the breaker from being switched to an on position if the neutral connection is not made to insure that the advanced electronics protection features are active.

BRIEF SUMMARY

A disclosed example is a circuit breaker with a neutral connector lockout mechanism. The circuit breaker has a trip mechanism that includes a handle which when in the on position, allows current flow between a load side connector and a line side connector. When tripped either mechanically via the heating of a metallic strip or electronically via the detection of a fault condition, a spring in the trip mechanism causes the handle to move to a tripped state thereby breaking the connections between the load side and line side connector. In order to reset the circuit breaker, the handle must be placed in an off position allowing the handle to be then moved to the on position and reestablishing the electrical connection between the load side connector and the line side connector. The circuit breaker includes a neutral connector that is connected to a neutral rail in a panel board and coupled to the power source. If the neutral connector is removed from the neutral rail, the circuit breaker will be tripped via a neutral lock-out mechanism. Without a neutral rail in the connector, the neutral lock-out mechanism prevents the circuit breaker from being reset to the on position. In such a manner, the circuit breaker protects against an open ground condition where the neutral rail is not connected and prevents the circuit breaker from being activated without the advanced electronics-driven tripping features from being used.

Three different neutral lock-out mechanisms are provided as examples. All three lock-out mechanisms use a trip link that when in a down position prevents the trip mechanism from being reset. The trip link also is moved to the down position when the neutral connector is removed from the neutral rail. A spring biases the lock-out mechanisms to move the trip link to the down position if the neutral connector is removed in all three mechanisms. The first mechanism links the lower jaw of a jaw type neutral connector to the spring. A rod connects the lower jaw with the trip link. The insertion of the neutral connector onto the neutral rail forces the lower jaw to rotate and pull the spring to a trigger position. The rotation of the lower jaw results in releasing the trip link allowing the trip mechanism to be reset.

A second example mechanism uses a rotating cam having an arm linked to the spring and a rod in contact with the trip link. When the neutral connector is removed from the neutral rail, the cam is rotated by the spring and the rod prevents the trip link from moving upward therefore preventing the trip mechanism from being reset. When the neutral connector is inserted onto the neutral rail, the neutral rail contacts the cam causing it to rotate and tensions the spring. The rod is moved upward allowing the trip link upward motion to reset the trip mechanism.

A third example mechanism uses a slider that has an arm in contact with the trip link. A compression spring forces the slider in a down position preventing the trip link from moving upward thereby preventing the trip mechanism from being reset. When the neutral connector is inserted onto the neutral rail, the slider is forced upward by the neutral rail thereby compressing the spring. The upward position of the slider allows the trip link to move upward permitting the resetting of the trip mechanism.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1B:
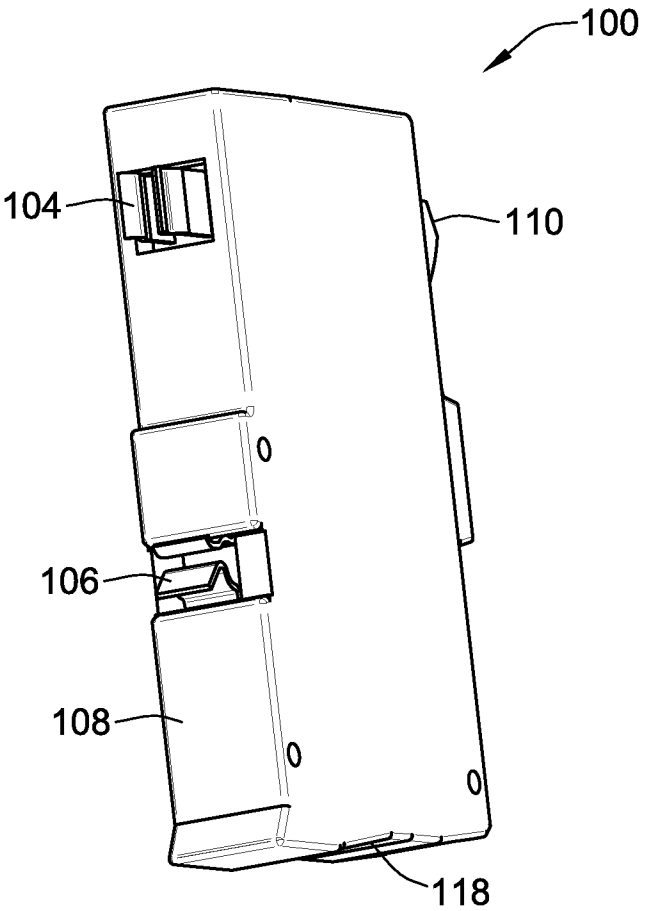
FIG. 1B is a perspective view of the back of the circuit breaker in FIG. 1A.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

One disclosed example is a circuit breaker preventing electrical connection between a power line source and a load when a neutral rail is disconnected from the circuit breaker. The circuit breaker includes a line connector, a load connector and a neutral plug-on line connector. A trip mechanism has an on position allowing electrical connection between the line connector and the load connector, a tripped position interrupting electrical connection between the line connector and the load connector in response to detection of at least one fault condition, and an off position which is required before resetting the trip mechanism to the on position. A trip link is coupled to the trip mechanism, the trip link having a first position preventing the trip mechanism from being reset to the on position and a second position allowing the trip mechanism to be reset to the on position. A neutral lock mechanism is coupled to the neutral line connector. The neutral lock mechanism includes a spring that retains the trip link in the first position when the neutral rail is disconnected from the neutral plug-on line connector. The neutral lock mechanism actuates the spring when the neutral rail is connected to the neutral line connector allowing the trip link to move to the second position.

A circuit breaker prevents electrical connection between a power line source and a load when a neutral rail is disconnected from the circuit breaker. The circuit breaker includes a casing, a line connector affixed to one side of the casing, a load connector affixed to an opposite side of the casing and a neutral plug-on line connector having an upper jaw half and a lower jaw half allowing the neutral rail to be plugged on between the upper and lower jaws halves. A trip mechanism includes a handle. The trip mechanism has an on position allowing electrical connection between the line connector and the load connector and a tripped position interrupting electrical connection between the line connector and the load connector in response to detection of at least one fault condition. The trip mechanism also has an off position and the handle must be moved to the off position to reset the trip mechanism to the on position. A trip link is coupled to the trip mechanism. The trip link has a first position preventing the trip mechanism from being reset to the on position and a second position allowing the trip mechanism to be reset to the on position. A neutral lock mechanism is coupled to the neutral line connector. The neutral lock mechanism includes a spring coupled to the casing that retains the trip link in the first position when the neutral rail is unplugged from the neutral plug-on line connector. The neutral rail causes the neutral lock mechanism to actuate the spring when the neutral rail is connected between the jaw halves of to the neutral plug-on line connector allowing the trip link to move to the second position.

Figure 1A:
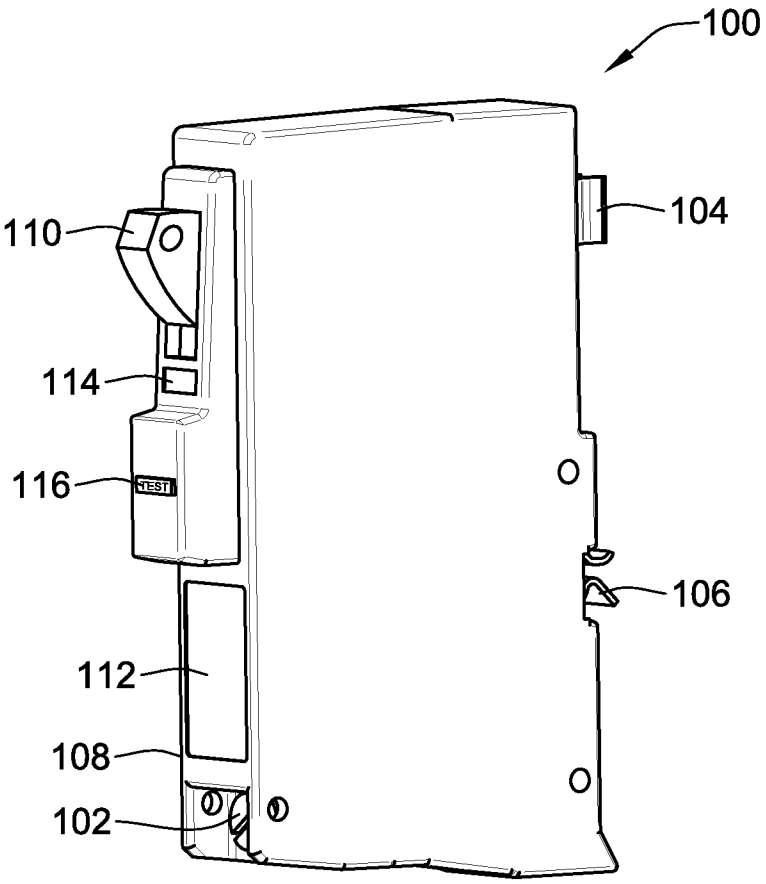
FIG. 1A is a perspective view of the front of a circuit breaker with a neutral connector locking mechanism.

Turning now to FIGS. 1A and 1B, a perspective view of the front and back of a circuit breaker 100 is shown. The circuit breaker 100 includes a load side connector 102, a power line connector 104, a plug-on panel neutral line connector 106 and a casing 108. The load side connector 102 is affixed to one side of the casing 108 and the power line connector 104 is affixed to the opposite side of the casing 108. A handle 110 connected to a trip mechanism (detailed below) is mounted on a front panel 112. The handle 110 may be placed in an on position (up position shown in FIG. 1A) that causes the circuit breaker 100 to allow current flow between the power line connector 104 and the load side connector 102. The handle 110 may be placed in a tripped condition cutting off current flow between the power line connector 104 and the load side connector 102. A lens 114 is mounted below the handle 110 and shows an indication that the handle 110 is in a trip condition. A test button 116 is provided to test the internal electronics of the circuit breaker 100. In this example, the circuit breaker 100 may be a miniature circuit breaker, such as the QO® and HOMELINE® family of circuit breakers available from Square D by Schneider Electric. However, it is to be understood that the principles discussed herein may be applied to other types of circuit breakers. A power line source such as a panel board is coupled to the circuit breaker 100 via connecting the line side connector 104 to the power line and a neutral line side rail to the plug-on panel neutral line connector 106. A load may be connected to the circuit breaker by connecting the load side connector 102 to the power line to the load and a load neutral connector 118 to a neutral terminal on the load.

Figure 2A:
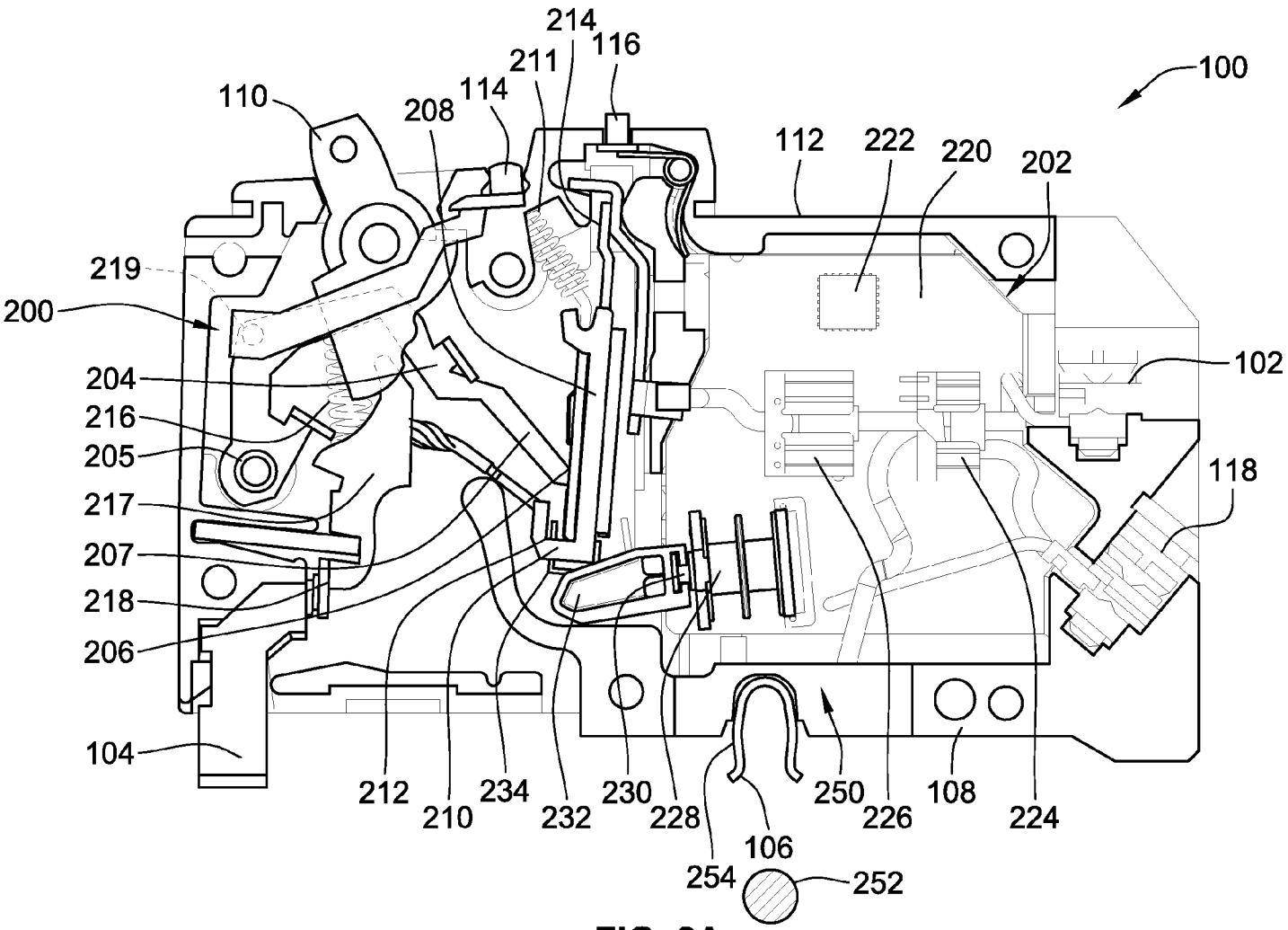
FIG. 2A is a cross section view of the internal components of the circuit breaker in FIG. 1A with the handle in the on position.
Figure 2C:
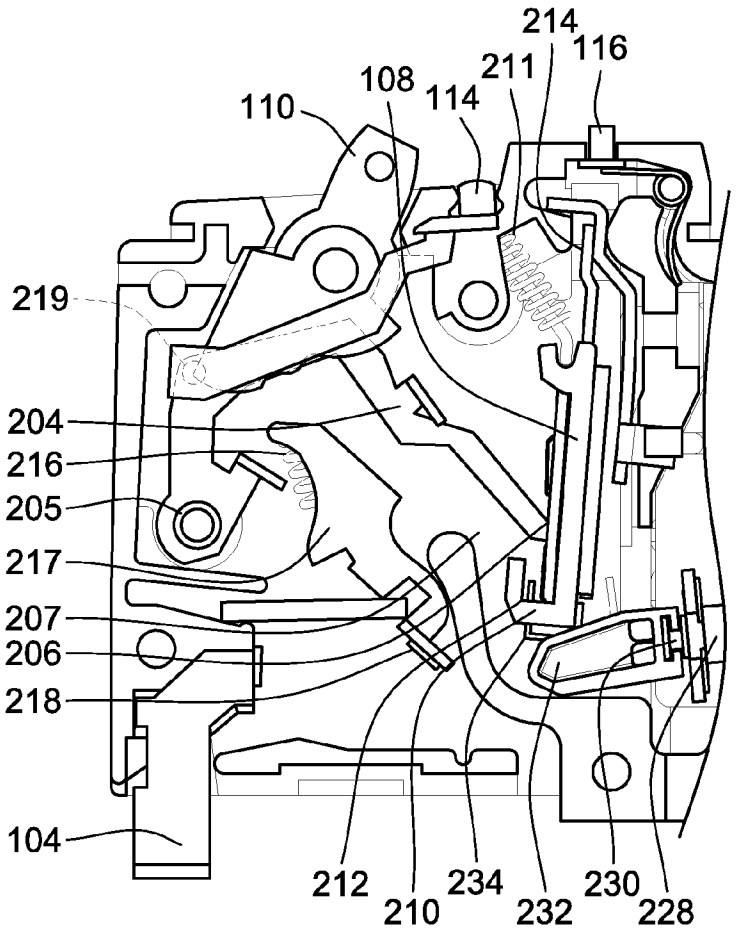
FIG. 2C is a cross section partial view of the internal components of the circuit breaker in FIG. 1A with the handle in the off position for a reset.
Figure 2B:
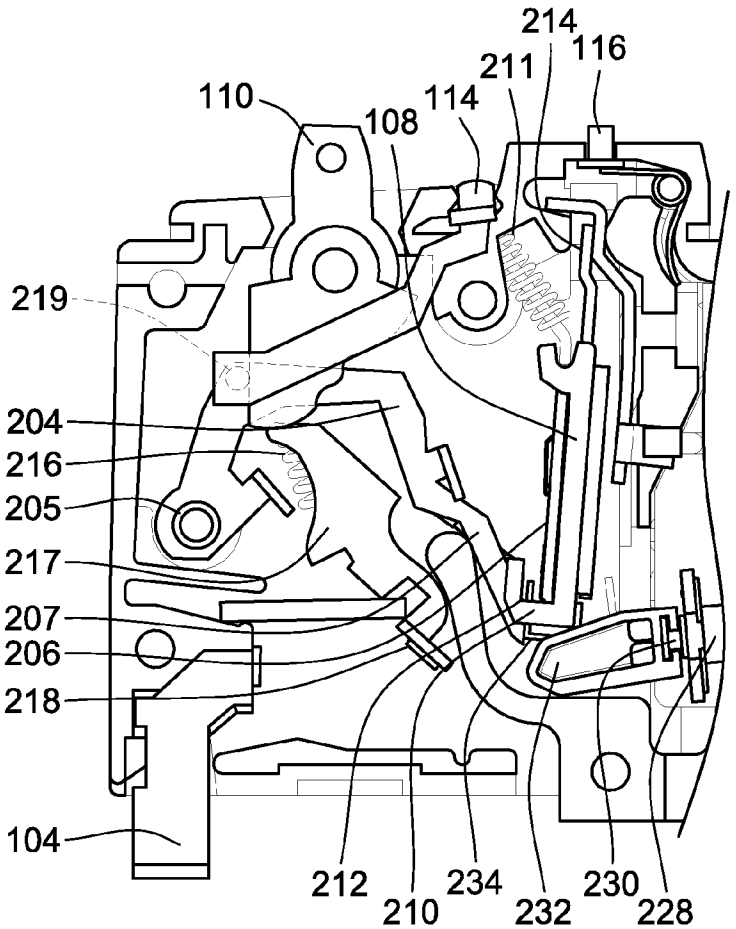
FIG. 2B is a cross section partial view of the internal components of the circuit breaker in FIG. 1A with the handle in the tripped position.

FIGS. 2A-2C are cross section views of the internal components of the circuit breaker 100 in FIGS. 1A-1B with the cover of the casing 108 removed. Like elements from FIG. 1A-1B have like element numbers in FIGS. 2A-2C. The circuit breaker 100 contains a trip mechanism 200 and an electronics module 202. The trip mechanism 200 includes a trip lever 204 connected to the handle 110. The trip lever 204 is roughly U-shaped having one end 205 that is in pivoting connection with the casing 108. A latch 207 of the trip lever 204 is engaged with a slot in a latch seat 206 of an armature 208. The armature 208 is in a calibrated position such that a free end 210 of the armature 208 contacts a yoke hook 212. The armature 208 is biased in the calibrated position via a spring 211. The yoke hook 212 may be triggered by a bi-metal strip 214 that bends when a heat threshold is exceeded by current flowing through the bi-metal strip 214, thus causing the armature 208 to be released from the yoke hook 212 and releases the latch 207 from the latch seat 206. A rotating contact arm 217 is rotatably coupled to the handle 110. A spring 216 is coupled between the rotating contact arm 217 and the trip lever 204 and drives the trip lever 204 and handle 110 to the trip position (shown in FIGS. 1A and 2B). The movement of the trip lever 204 to the trip position breaks the electrical path between the power line connector 104 and the load power connector 102 by moving a contact 218 of the contact arm 217 away from the power line connector 104.

As shown in FIG. 2B, the handle 110 is in the tripped position. The trip lever 204 has rotated to a down position by force applied by the spring 216 because the latch 207 has been tripped and moved out of the latch seat 206. The rotating contact arm 217 has also been moved by the spring 216 to a downward position separating the contact 218 from the power line connector 104. As shown in FIG. 2B, the handle 110 is in contact with a pin 219 which protrudes from the trip lever 204.

In order to reset the handle 110 to the on position, the handle 110 is moved to the off position as shown in FIG. 2C. The movement of the handle 110 tensions the spring 216 by rotating the trip lever 204 via pushing against the protruding pin 219. The trip lever 204 is thus rotated so the latch 207 rests in the latch seat 206 of the armature 208.

The handle 110 is then moved to the on position as shown in FIG. 2A. In doing so, the contact arm 217 is rotated to bring the contact 218 to create an electrical contact with the power line connector 104. In doing so, the contact arm 217 stretches the spring 216. The trip lever 204 remains in the upward position because the latch 207 remains engaged in the latch seat 206 of the armature 208.

The electronics module 202 includes a circuit board 220 that mounts a microprocessor 222, a ground fault sensor 224, a current sensor 226, and a trip solenoid 228. It is to be understood that the functions of the microprocessor 222 may be performed by a processor, microcontroller, controller, and/or one or more other suitable processing device(s) such as an application specific integrated circuit (ASIC), a programmable logic device (PLD), a field programmable logic device (FPLD), a field programmable gate array (FPGA), discrete logic, etc.

The microprocessor 222 may electronically cause the circuit breaker 100 to trip based on signals sensed by the ground fault sensor 224 or the current sensor 226 from the current flowing between the load connector 102 and the line connector 104. On detection of a fault condition, the microprocessor 222 sends a signal to a trip circuit that causes the trip solenoid 228 to activate a plunger 230 to pull a connected trip link 232 down. The trip link 232 includes a clamp 234 that is in contact with the armature 208. When the trip link 232 is motivated by the plunger 230 being activated by the solenoid 228, it moves downward pushing the clamp 234 thus causing the armature 208 to move downward to release the latch 207 causing the spring 216 to drive the trip lever 204 and handle 110 to the trip position thus breaking the electrical path between the line connector 104 and the load connector 102. The microprocessor 222 analyzes the signals from the sensors 224 and 226 for indicators of fault conditions that may include, but are not limited to ground faults, arcing faults, overloads, and short-circuits. When the microprocessor 222 determines a safe condition, it deactivates the solenoid 228 releasing the plunger 230 and pushing the trip link 232 and the clamp 234 upwards. This allows the armature 208 to be tensioned in the set position to hold the latch 207 of the trip lever 204 as shown in FIG. 2A The microprocessor 222 monitors the inputs from several input circuits mounted on the circuit board 220 including a zero crossing circuit and voltage monitoring circuit, a differential current sensor circuit, an integrator circuit, a high frequency detection circuit, a push to test circuit, and a temperature sensor circuit. In this example, the differential current sensor circuit is coupled to the ground fault sensor 224. The ground fault sensor 224 and differential current sensor circuit provide an input to the microprocessor 222 indicating the presence of a ground fault or arcing ground fault from the load connector 102. The current sensor 226 and the integrator circuit provide an input to the microprocessor 222 indicating the presence of an arc fault on the load connector 102.

A neutral locking mechanism 250 is coupled to a neutral line rail 252 which is coupled to a neutral terminal of the power line source such as a panel board (not shown). The neutral locking mechanism 250 prevents the resetting of the circuit breaker 100 if the neutral line rail 252 is not connected to the plug-on neutral line connector 106. The neutral locking mechanism 250 also trips the circuit breaker 100 if the neutral rail 252 is disconnected from the plug-on neutral line connector 106. Three separate arrangements for the locking mechanism 250 are disclosed that work in conjunction with the circuit breaker 100. In each of arrangements for the neutral locking mechanism 250, the plug-on neutral line connector 106 includes a jaw coupler 254 that clamps onto the neutral rail 252.

Each of the mechanisms described below uses a tension or compression spring to bias the lock-out mechanism to a position that holds the trip mechanism 200 shown in FIG. 2A in the tripped position shown in FIG. 2B preventing a reset of the circuit breaker 100. Each of the embodiments has a mechanical member which contacts the neutral rail 252 in the jaw coupler 254 in such a way that as when the neutral rail 252 is connected to the neutral connector 106 of the circuit breaker 100, the lock-out mechanism is displaced, overcoming the spring bias from the tension spring, and actuates the lock-out mechanism to a position that frees the restraint on the trip mechanism 200 allowing the handle 110 to be reset to the on position. After the trip mechanism 200 is freed, the circuit breaker 100 can then be reset by moving handle 110 to the off position shown in FIG. 2C and then the handle 110 may be moved to the on position as shown in FIG. 2A. Likewise if the circuit breaker 100 is installed between the load and the power line source, but the panel neutral rail 252 is disconnected or unplugged from the jaw coupler 254 of the neutral line connector 106 while the circuit breaker 100 is in either the on or off position in FIG. 2A or 2C, the spring in the lock-out mechanism 250 will cause the trip mechanism 200 to be moved to the tripped position in FIG. 2B therefore interrupting power between the power source and the load.

Figure 3A:
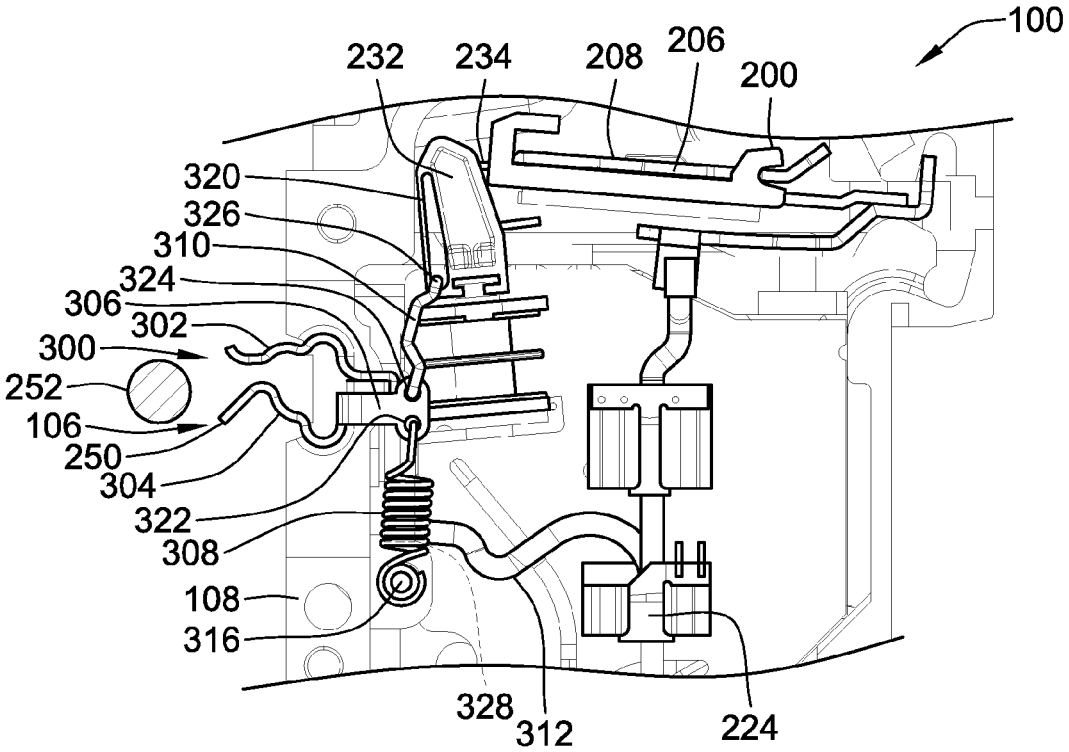
FIG. 3A is a cross section view of a first arrangement of the neutral connection mechanism in the locked position preventing the reset of the circuit breaker in FIGS. 1A-1B.
Figure 3B:
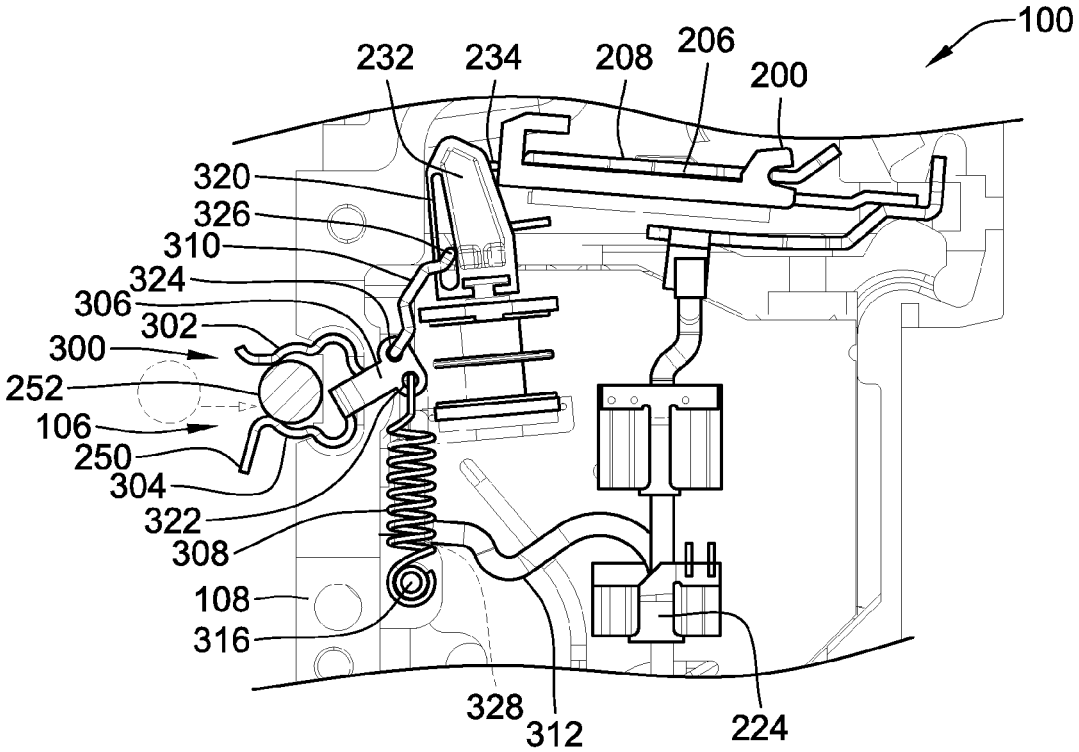
FIG. 3B is a cross section view of the arrangement in FIG. 3A with a neutral connection mechanism connected to a neutral rail allowing the reset of the circuit breaker in FIGS. 1A-1B.
Figure 4A:
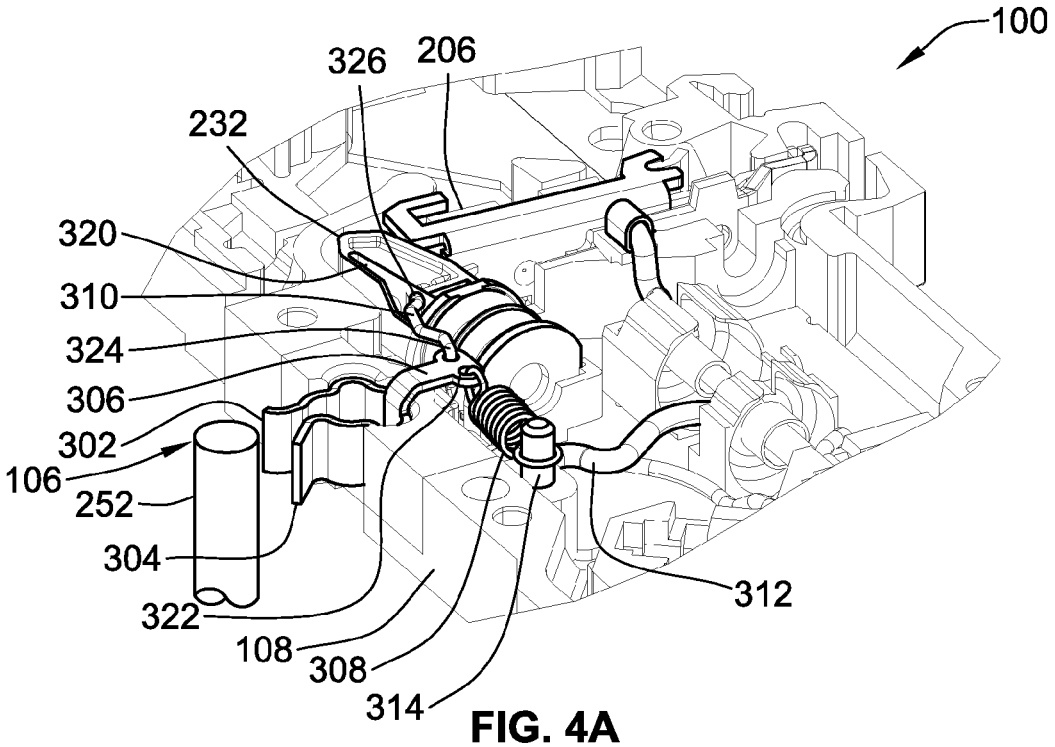
FIG. 4A is a perspective view of the first arrangement in FIG. 3A in the locked position preventing the reset of the circuit breaker in FIGS. 1A-1B.
Figure 4B:
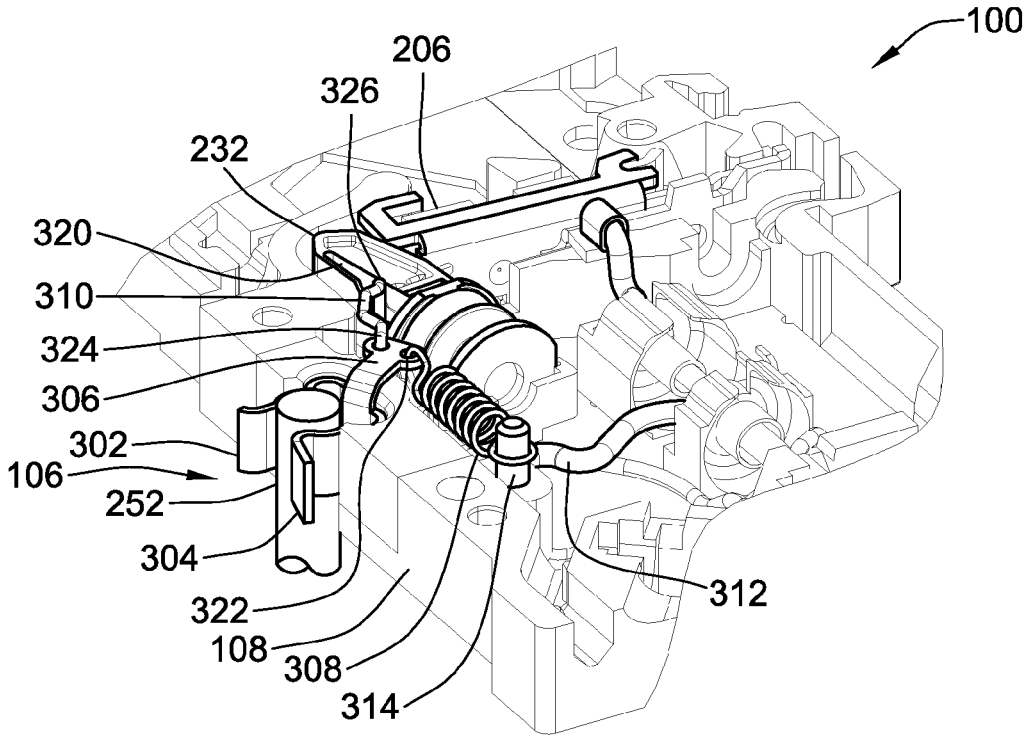
FIG. 4B is a perspective view of the first arrangement in FIG. 3A with the neutral connection mechanism allowing the reset of the circuit breaker in FIGS. 1A-1B.

FIGS. 3A-3B are cross section views and FIGS. 4A-4B are perspective views of a first arrangement 300 which may constitute the neutral locking mechanism 250 for the circuit breaker 100 shown in FIGS. 1A-1B and FIGS. 2A-2C. Like element numbers in FIGS. 1 and 2 are designated with the same element numbers in FIGS. 3 and 4. FIGS. 3A and 4A show the arrangement 300 in the locked position that prevents the trip mechanism 200 from being reset to the on position shown in FIG. 2A. FIGS. 3B and 4B show the arrangement 300 where the neutral conductor rail 252 is connected in the neutral line conductor 106 and therefore allows the trip mechanism 200 to be reset to the on position as shown in FIG. 2A.

In the arrangement 300 shown in FIGS. 3-4, the jaw coupler 254 includes a fixed upper jaw half 302 and a rotating lower jaw half 304. The rotating lower jaw half 304 is coupled to a pivoting actuating arm 306. The pivoting actuating arm 306 is coupled to a tensioning spring 308 that biases the rotating lower jaw half 304 to the position shown in FIG. 3A to pull a rod 310 to hold the trip link 232 in a downward position thus preventing the trip mechanism 200 from being reset to the on position as shown in FIG. 2A. A neutral wire 312 is coupled through the ground fault sensor 224 and is connected to the circuit board 220 in FIGS. 2A and 2B. FIGS. 3B and 4B shows the neutral line rail 252 which is connected to the jaw coupler 254.

The upper jaw half 302 is preferably made of a conductive metal such as copper alloy while the lower jaw half 304 is preferably made of steel to handle higher stress. The upper jaw half 302 is the primary conductor path for the neutral connection, as well as supporting the clamp load. The lower jaw half 304 transfers the energy from the tension spring 308 to create the clamp on the neutral rail 252. The lower jaw half 304 also actuates the lockout mechanism 250. In this example the lock mechanism 250 includes a slot 320 in the trip link 232. The lower jaw half 304 is coupled to the actuating arm 306 which contacts the trip link 232 via the rod 310. The tension spring 308 creates the mechanical force to actuate the neutral locking mechanism 250. One end of the spring 308 is attached to a post 314 in the casing 108 of the circuit breaker 100. The other end of the spring 308 is hooked into a hole 322 of the actuating arm 306. Another hole 324 on the actuating arm 306 holds a hooked shaped end of the rod 310. The opposite end of the rod 310 includes an arm 326 that extends into the slot 320 in the trip link 232. The neutral wire 312 is soldered to a clip 328 that provides electrical connection to the jaw coupler 254.

As shown in FIGS. 3A and 4A, the lock mechanism arrangement 300 locks the armature 208 in the tripped (lower) position when the neutral rail 252 is not held by the upper and lower jaw halves 302 and 304. The armature 208 in the lower position prevents the latch 207 from being engaged with the latch seat 206 and therefore the handle 110 cannot be moved to on position shown in FIG. 2A. Without the neutral rail 252, the actuating arm 306 is pulled in a clockwise direction by the tension spring 308 and thereby the arm 326 of the rod 310 sits in the bottom of the slot 320 and therefore prevents the trip link 232 from moving upward. Since the trip link 232 restricts the movement of the clamp 234 which is in turn coupled to the armature 208, the armature 208 is prevented from moving upward as well.

When the neutral rail 252 is inserted in the jaw coupler 254 as shown in FIGS. 3B and 4B, the rail 252 pushes the lower jaw half 304 down thereby rotating the actuating arm 306 in a counterclockwise direction. The actuating arm 306 therefore stretches the tension spring 308 by the rotational motion. The actuating arm 306 also moves the rod 310 up so the arm 318 travels upwards in the slot 320 of the trip link 232. The lock mechanism arrangement 300 therefore allows the trip link 232 to be moved upward to allow the armature 208 to be tensioned upward allowing the latch 207 to be reset to the on position. If the neutral rail 252 is removed, the tension spring 308 pulls the pivoting actuating arm 306 in a clockwise direction thus causing the rod 310 to pull the arm 318 down in the slot 320 and moving the trip link 232 down. The trip link 232 moves the clamp 234 downward causing the armature 208 to move downward releasing the latch 207 of the trip lever 204 and causing the trip mechanism 200 to be triggered to the trip position shown in FIG. 2B.

Figure 5A:
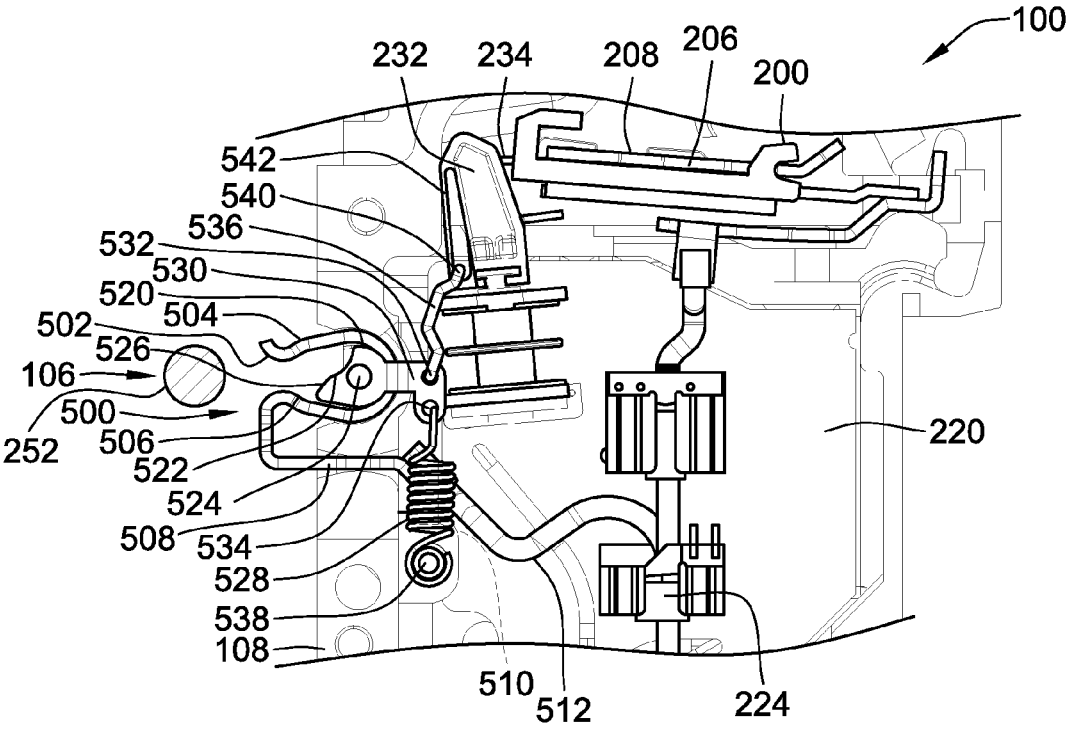
FIG. 5A is a cross section view of a second arrangement of the neutral connection mechanism in the locked position preventing the reset of the circuit breaker in FIGS. 1A-1B.
Figure 5B:
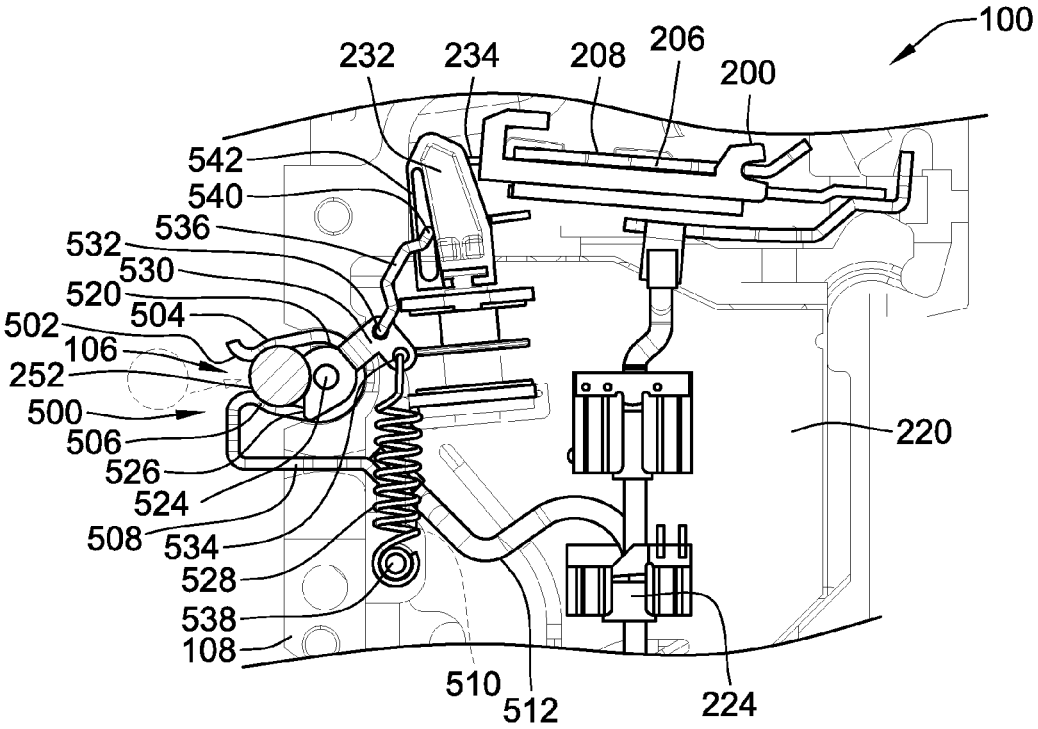
FIG. 5B is a cross section view of the second arrangement in FIG. 3A with the neutral connection mechanism connected to a neutral rail allowing the reset of the circuit breaker in FIGS. 1A-1B.
Figure 6A:
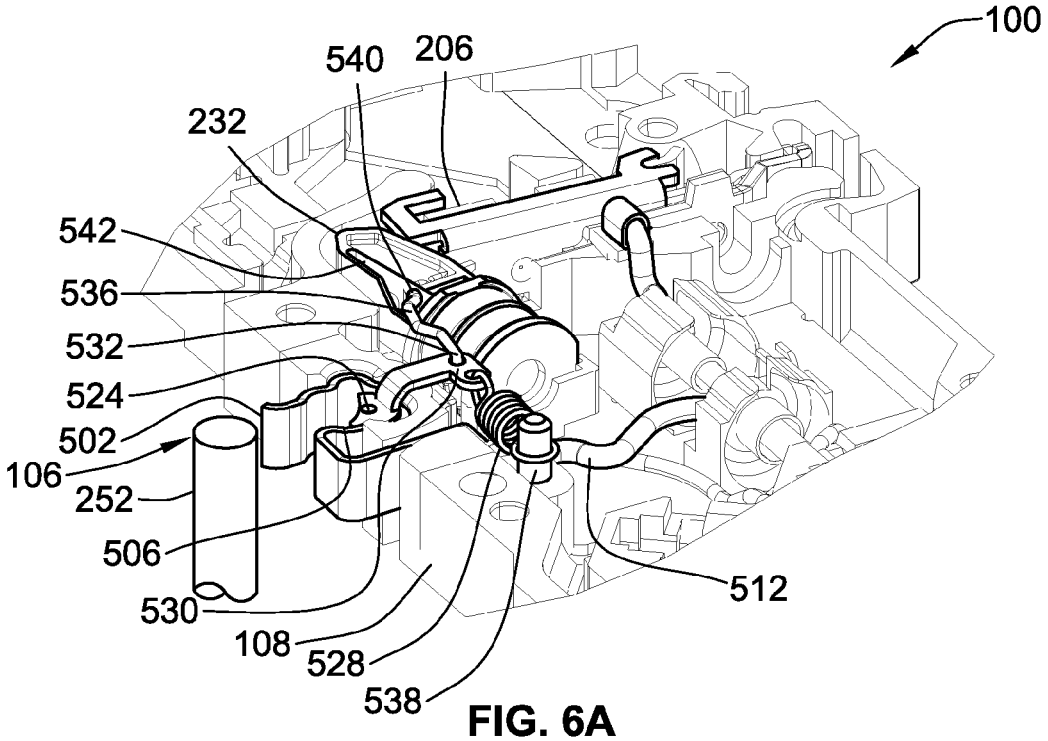
FIG. 6A is a perspective view of the second arrangement in FIG. 5A of the neutral connection mechanism in the locked position preventing the reset of the circuit breaker in FIGS. 1A-1B.
Figure 6B:
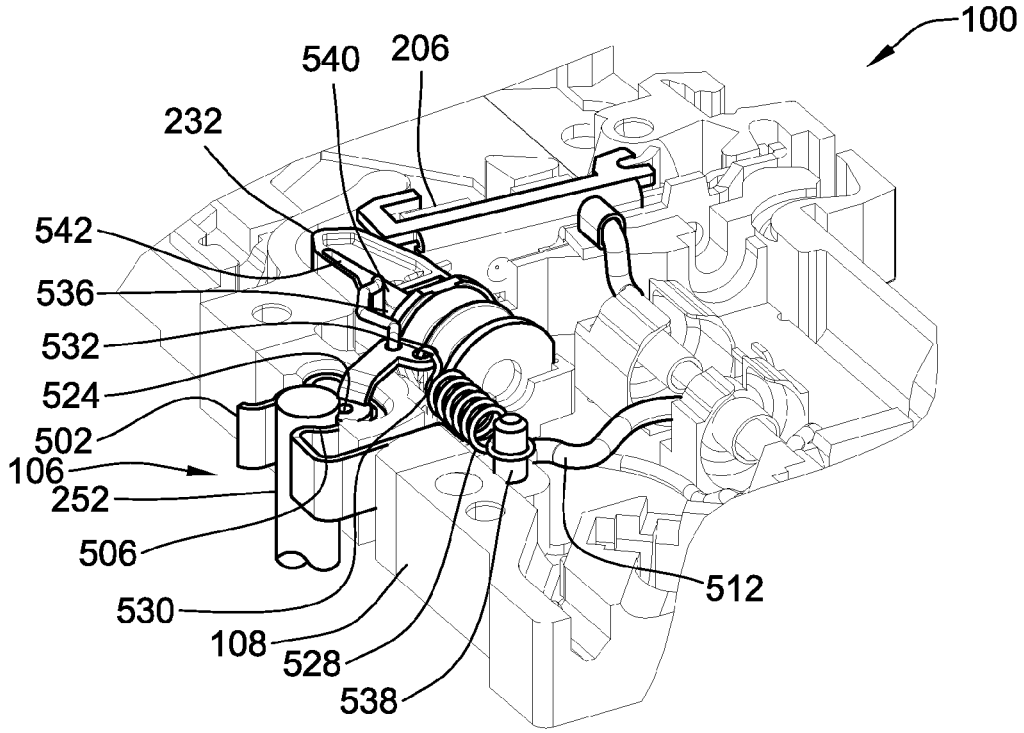
FIG. 6B is a perspective view of the second arrangement in FIG. 5A with the neutral connection mechanism allowing the reset of the circuit breaker in FIGS. 1A-1B

FIGS. 5A and 5B are cross section views of and FIGS. 6A-6B are perspective views of a second arrangement 500 that constitute the neutral lock out mechanism 250 in FIGS. 2A-2C. Like element numbers in FIGS. 1 and 2 are designated with the same element numbers in FIGS. 5 and 6. The second arrangement 500 is similar to the first arrangement 300 in FIGS. 3-4. The second mechanism 500 includes an integrated neutral jaw/clip 502. The neutral jaw/clip 502 has an upper jaw half 504 and a lower jaw half 506 that clamp a neutral line rail such as the neutral line rail 252 in FIGS. 5B and 6B in electrical connection to the circuit breaker 100. The lower jaw 506 is coupled to a tab 508 that creates an electrical connection via a clamp 510 to a neutral wire 512 that in turn is coupled through the current sensor 224 to the circuit board 220.

A pivoting cam 520 rotates independently of the jaw halves 504 and 506. The pivoting cam 520 includes a hole 522 that rotates around a pin 524 on the casing 108 of the circuit breaker 100. The cam 520 includes a chamfer 526 that is biased by a tension spring 528. The chamfer 526 is pushed downward (counter clockwise) by the insertion of the neutral rail 252 as shown in FIGS. 5B and 6B. The cam 520 further includes an arm 530 having a hole 532 for the insertion of one end of the tension spring 528 and another hole 534 for the insertion of a hooked end of a rod 536. The opposite end of the tension spring 528 is hooked into a post 538 formed in the casing 108. The opposite end of the rod 536 includes an arm 540 that is engaged in a slot 542 in the trip link 232.

As shown in FIGS. 5A and 6A, the lock out mechanism arrangement 500 locks the armature 208 in the tripped (lower) position when the neutral rail 252 is not held by the upper and lower jaw halves 504 and 506. The armature 208 in the lower position prevents the latch 207 from being engaged with the latch seat 206 and therefore the handle 110 cannot be moved to the on position shown in FIG. 2A. The cam 520 is pulled in a clockwise direction by the tension spring 528 thereby causing the arm 540 of the rod 536 to sit in the bottom of the slot 542 and therefore prevents the trip link 232 from moving upward as shown in FIGS. 5A and 6A. Since the trip link 232 restricts the upward movement of the clamp 234 which is in turn coupled to the armature 208, the armature 208 is prevented from moving upward and holding the latch 207 of the trip lever 204.

When the neutral line rail 252 is inserted in the jaw connector 502 as shown in FIGS. 5B and 6B, the neutral line rail 252 pushes the chamfer 526 down thereby rotating the cam 520 and arm 530 in a counterclockwise direction. The arm 530 therefore causes tensioning of the tension spring 528. The arm 530 also moves the rod 536 up so the arm 540 travels upwards in the slot 542 of the trip link 232. The lock out mechanism arrangement 500 therefore allows the trip link 232 to be moved upward in the position shown in FIGS. 5B and 6B. This allows the clamp 234 to move upward and therefore allows the armature 208 to be tensioned upward allowing the latch 207 to be reset to the on position. If the neutral rail 252 is removed, the spring 528 pulls the cam 520 in a clockwise direction thus causing the rod 536 to pull the arm 540 down in the slot 542 and moving the trip link 232 down. The trip link 232 causes the clamp 234 to move downward and thereby causes the armature 208 to move downward releasing the latch 207 of the trip lever 204 and causing the trip mechanism 200 to be triggered to the trip position shown in FIG. 2B.

The neutral jaw/clip 502 mechanically fastens the circuit breaker 100 to the neutral rail 252 and provides the electrical connection to the neutral rail from the power source. The pivoting cam 520 actuates the mechanism 500. The chamfer surface 526 causes the cam 520 to rotate when it contacts the neutral line rail 252 and provides a connection point for the rod 536 and tension spring 528 as described above. The cam 520 of the arrangement 500 allows some rotational freedom of the neutral jaw/clip 502 to maintain ease of installation of the circuit breaker 100 to a load, and at the same time positions the neutral jaw/clip 502 so it will not interfere with the operation of the parts of the lock-out mechanism such as the cam 520.

Figure 7A:
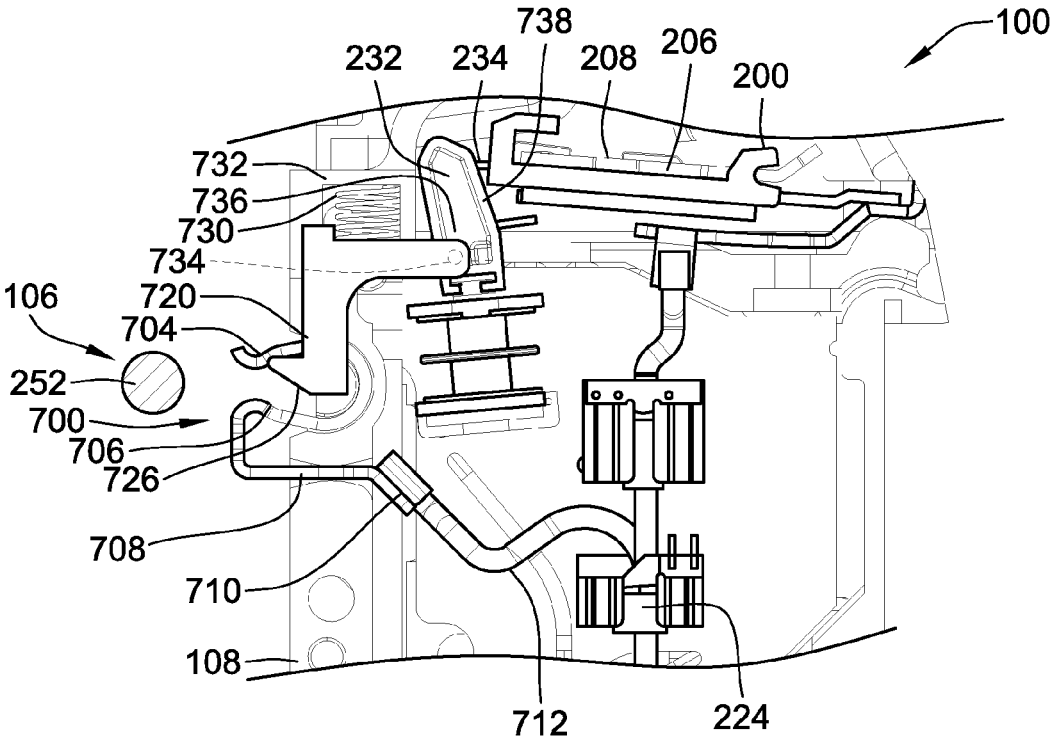
FIG. 7A is a cross section view of a third arrangement of the neutral connection mechanism in the locked position preventing the reset of the circuit breaker in FIGS. 1A-1B.
Figure 7B:
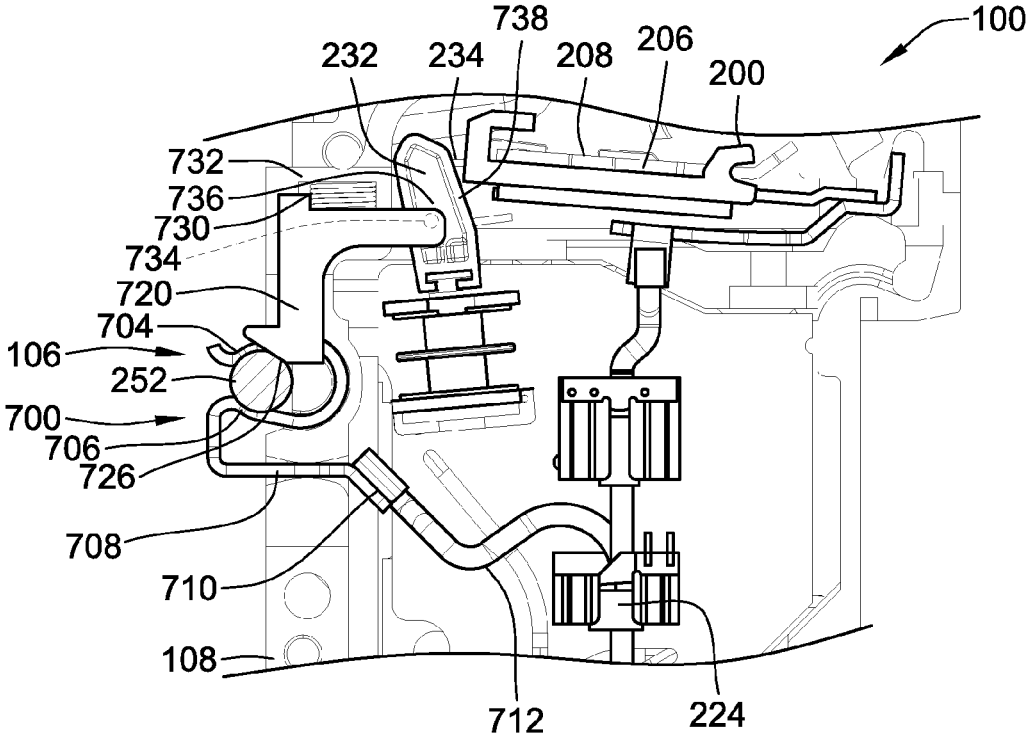
FIG. 7B is a cross section view of the third arrangement in FIG. 7A with the neutral connection mechanism connected to a neutral rail allowing the reset of the circuit breaker in FIGS. 1A-1B.
Figure 8A:
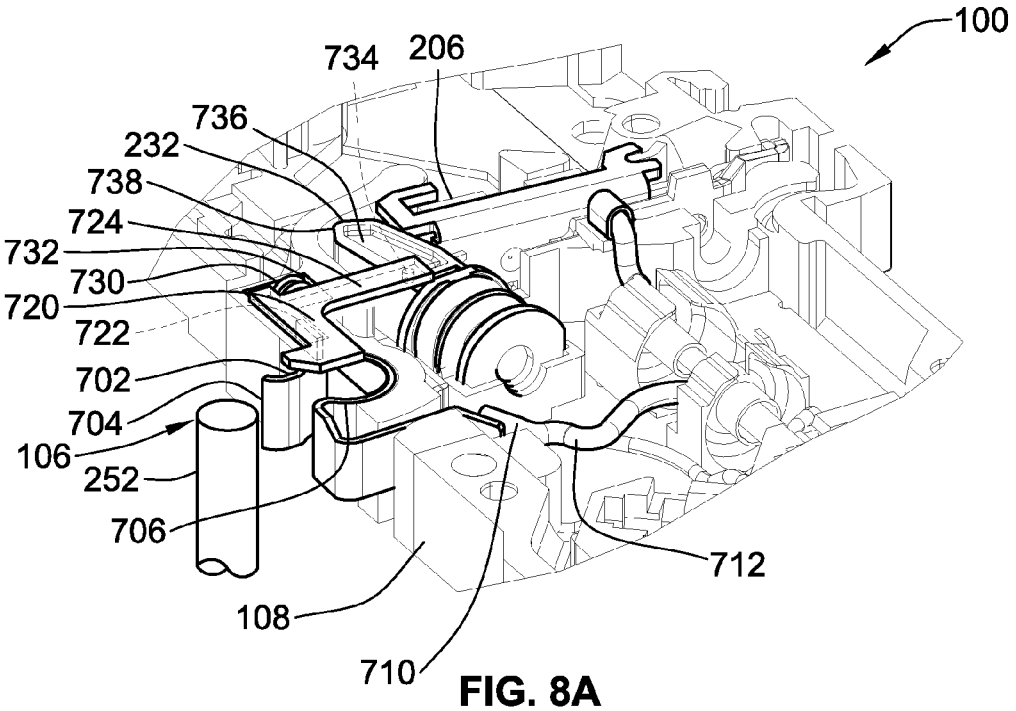
FIG. 8A is a perspective view of the third arrangement of the neutral connection mechanism in the locked position preventing the reset of the circuit breaker in FIGS. 1A-1B.
Figure 8B:
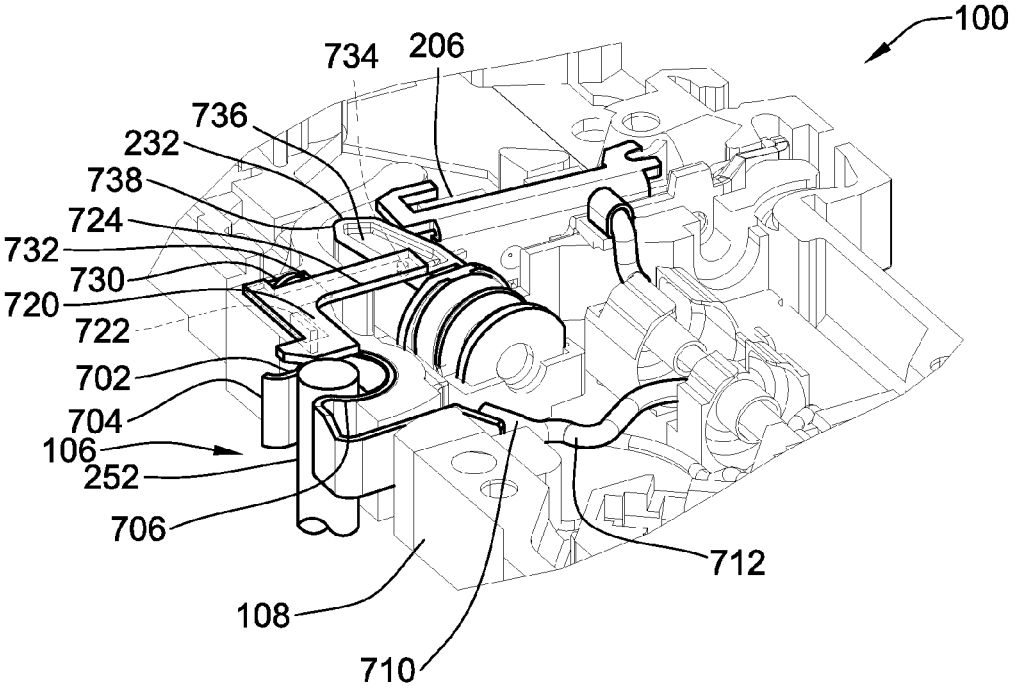
FIG. 8B is a perspective view of the third arrangement in FIG. 7A with the neutral connection mechanism connected to a neutral rail allowing the reset of the circuit breaker in FIGS. 1A-1B.

FIGS. 7A and 7B are cross section views of and FIGS. 8A-8B are perspective views of a third arrangement 700 that may constitute the neutral lock out mechanism 250 in FIGS. 2A-2C. Like element numbers in FIGS. 1 and 2 are designated with the same element numbers in FIGS. 7 and 8. The third arrangement 700 includes an integrated jaw coupler 702. The jaw coupler 702 as shown in FIGS. 8A and 8B has an upper jaw 704 and a lower jaw 706 that clamp a neutral line rail such as the neutral line rail 252 in FIGS. 7B and 8B to create an electrical connection to the circuit breaker 100. The lower jaw 706 is coupled to a tab 708 that creates an electrical connection via a clamp 710 to a neutral wire 712 that in turn is coupled through the current sensor 224 to the circuit board 220.

A slider 720 translates on a track (not shown) in the casing 108 of the circuit breaker 100 between an up and down position. The slider 720 includes an actuation arm 722 and a perpendicular spring arm 724. The actuation arm 722 has a sloped contact surface 726 that sits between the upper and lower jaws 704 and 706. The spring arm 724 is in contact with a compression spring 730 that rests in a recess 732 formed by the casing 108. The end of the spring arm 724 has a protruding pin 734. The pin 734 rests within a recess 736 formed by a border edge 738 of the trip link 232.

As shown in FIGS. 7A and 8A, the lock mechanism arrangement 700 locks the armature 208 in the tripped (lower) position when the neutral rail 252 is not held by the upper and lower jaw halves 704 and 706 of the integrated jaw coupler 702. The armature 208 in the lower position prevents the latch 207 from being engaged and therefore the handle 110 cannot be moved to the on position shown in FIG. 2A. The spring 730 pushes the slider 720 down thereby causing the pin 734 to sit in the bottom of the recess 736 and against the border 738 of the trip link 232. This prevents the trip link 232 from moving upward as shown in FIGS. 7A and 8A. Since the trip link 232 restricts the upward movement of the clamp 234 which is in turn coupled to the armature 208, the armature 208 is prevented from moving upward as well.

When the neutral rail 252 is clamped in the jaw connector 702 as shown in FIGS. 7B and 8B, the neutral line rail 252 pushes against the contact surface 726 thereby forcing the slider 720 to move upwards and compress the spring 730. The arm 724 also moves the pin 734 up so the trip link 232 may be moved upward in the position shown in FIGS. 7B and 8B. This allows the clamp 234 to move upward and therefore allows the armature 208 to be tensioned upward allowing the latch 207 to be reset to the on position. If the neutral rail 252 is removed, the spring 730 pushes the slider 720 downward causing the pin 734 to push against the border 738 and pull the trip link 232 down. The trip link 232 causes the clamp 234 to move downward and thereby causes the armature 208 to move downward releasing the latch 207 of the trip lever 204 and causing the trip mechanism 200 to be triggered to trip the position shown in FIG. 2B.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A circuit breaker preventing electrical connection between a power line source and a load when a neutral rail is disconnected from the circuit breaker, the circuit breaker comprising:

a line connector;

a load connector;

a neutral plug-on line connector;

a trip mechanism having an on position allowing electrical connection between the line connector and the load connector, a tripped position interrupting electrical connection between the line connector and the load connector in response to detection of at least one fault condition, and an off position which is required before resetting the trip mechanism to the on position;

a trip link coupled to the trip mechanism, the trip link having a first position preventing the trip mechanism from being reset to the on position and a second position allowing the trip mechanism to be reset to the on position; and a neutral lock mechanism coupled to the neutral plug-on line connector, the neutral lock mechanism including a spring that retains the trip link in the first position when the neutral rail is disconnected from the neutral plug-on line connector, the neutral lock mechanism actuating the spring when the neutral rail is connected to the neutral plug-on line connector allowing the trip link to move to the second position.

2. The circuit breaker of claim 1, wherein the neutral lock mechanism includes an upper jaw half and a rotating lower jaw half, the lower jaw half including a pivoting actuating arm coupled to the spring and a rod in contact with the trip link.

3. The circuit breaker of claim 1, wherein the neutral lock mechanism includes a cam having an arm coupled to the spring and a rod in contact with the trip link, the cam rotating between a first position holding the rod down, and a second position on insertion of the neutral rail moving the rod upward allowing the trip link to move to the second position.

4. The circuit breaker of claim 3, wherein the neutral lock mechanism further includes an upper jaw half and a lower jaw half, the cam rotating independently of the upper and lower jaw halves.

5. The circuit breaker of claim 1, wherein the neutral lock mechanism includes a slider having an actuating arm and a perpendicular spring arm in contact with the spring and the trip link, the slider having a first position wherein the perpendicular spring arm holds the trip link in the first position and a second position compressing the spring and allowing the trip link to move to the second position.

6. The circuit breaker of claim 1, further comprising:

a sensor electrically coupled to the line connector;

a microcontroller coupled to the sensor that receives power derived from a line current that passes through the circuit breaker when the circuit breaker is in the on state, the microcontroller detecting a fault condition and sending a trip signal; and a trip solenoid coupled to the trip link that causes the trip mechanism to trip the circuit breaker in response to receiving a trip signal from the microcontroller.

7. The circuit breaker of claim 6, wherein the fault conditions include a ground fault and an arc fault.

8. The circuit breaker of claim 1, wherein the trip link includes a slot that engages part of the neutral lock mechanism.

9. The circuit breaker of claim 1, wherein the trip link includes a recess that engages part of the neutral lock mechanism.

10. A circuit breaker preventing electrical connection between a power line source and a load when a neutral rail is disconnected from the circuit breaker, the circuit breaker comprising:

a casing;

a line connector affixed to one side of the casing;

a load connector affixed to an opposite side of the casing;

a neutral plug-on line connector having an upper jaw half and a lower jaw half allowing the neutral rail to be plugged on between the upper and lower jaws halves;

a trip mechanism including a handle, the trip mechanism having an on position allowing electrical connection between the line connector and the load connector, a tripped position interrupting electrical connection between the line connector and the load connector in response to detection of at least one fault condition, and an off position, wherein the handle must be moved to the off position to reset the trip mechanism to the on position;

a trip link coupled to the trip mechanism, the trip link having a first position preventing the trip mechanism from being reset to the on position and a second position allowing the trip mechanism to be reset to the on position; and a neutral lock mechanism coupled to the neutral plug-on line connector, the neutral lock mechanism including a spring coupled to the casing that retains the trip link in the first position when the neutral rail is unplugged from the neutral plug-on line connector, the neutral rail causing the neutral lock mechanism to actuate the spring when the neutral rail is connected between the jaw halves of to the neutral plug-on line connector allowing the trip link to move to the second position.

11. The circuit breaker of claim 10, wherein the lower jaw half rotates on a pivot point on the casing, and wherein the neutral lock mechanism includes a pivoting actuating arm connected to the lower jaw half, the arm including one end coupled to the spring and coupled to a rod in contact with the trip link.

12. The circuit breaker of claim 10, wherein the neutral lock mechanism includes a cam having an actuating arm having one end coupled to the spring and a rod in contact with the trip link, the cam rotating between a first position holding the rod down, and a second position on connection of the neutral rail between the two jaw halves moving the rod upward allowing the trip link to move to the second position.

13. The circuit breaker of claim 12, wherein the cam rotates independently of the upper and lower jaw halves.

14. The circuit breaker of claim 10, wherein the neutral lock mechanism includes a slider having an actuating arm and a perpendicular spring arm in contact with the spring and the trip link, wherein the spring is located in a recess in the casing, the slider having a first position wherein the perpendicular spring arm holds the trip link in the first position and a second position compressing the spring and allowing the trip link to move to the second position.

15. The circuit breaker of claim 10, further comprising:

a sensor electrically coupled to the line connector;

a microcontroller coupled to the sensor that receives power derived from a line current that passes through the circuit breaker when the circuit breaker is in the on state, the microcontroller detecting a fault condition and sending a trip signal; and a trip solenoid coupled to the trip link that causes the trip mechanism to trip the circuit breaker in response to receiving a trip signal from the microcontroller.

16. The circuit breaker of claim 15, wherein the fault conditions include a ground fault and an arc fault.

* * * * *